US006956955B1

(12) United States Patent
Brungart

(10) Patent No.: US 6,956,955 B1
(45) Date of Patent: Oct. 18, 2005

(54) SPEECH-BASED AUDITORY DISTANCE DISPLAY

(75) Inventor: Douglas S. Brungart, Beavercreek, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 944 days.

(21) Appl. No.: 09/922,168

(22) Filed: Aug. 6, 2001

(51) Int. Cl.[7] ..... H04R 5/02
(52) U.S. Cl. ..... 381/310; 381/17
(58) Field of Search ..... 381/1, 17, 309, 381/310, 61, 104, 107

(56) References Cited

U.S. PATENT DOCUMENTS

| | | | | |
|---|---|---|---|---|
| 4,817,149 A | * | 3/1989 | Myers | 381/1 |
| 5,371,799 A | | 12/1994 | Lowe et al. | 381/25 |
| 5,438,623 A | | 8/1995 | Begault | 381/17 |
| 5,440,639 A | | 8/1995 | Suzuki et al. | 381/17 |
| 5,521,981 A | | 5/1996 | Gehring | 381/17 |
| 5,647,016 A | | 7/1997 | Takeyama | 382/103 |
| 5,742,689 A | * | 4/1998 | Tucker et al. | 381/17 |
| 5,809,149 A | | 9/1998 | Cashion et al. | 381/17 |
| 5,822,438 A | | 10/1998 | Sekine et al. | 381/17 |
| 5,987,142 A | * | 11/1999 | Courneau et al. | 381/17 |
| 6,072,877 A | | 6/2000 | Abel | 381/17 |
| 6,078,669 A | | 6/2000 | Maher | 381/17 |
| 6,118,875 A | | 9/2000 | Møller et al. | 381/1 |
| 2001/0040968 A1 | * | 11/2001 | Mukojima | 381/17 |

OTHER PUBLICATIONS

Brungart, D.S., "A Speech-Based Auditory Distance Display" AES 109th Convention, Los Angeles, Sep. 22-25, 2000.

* cited by examiner

*Primary Examiner*—Xu Mei
*Assistant Examiner*—Brian Tyrone Pendleton
(74) *Attorney, Agent, or Firm*—AFMCLO/JAZ; Gina S. Tollefson; Gerald B. Hollins

(57) ABSTRACT

Device and method for controlling the perceived distances of sound sources by manipulating vocal effort and presentation level of a synthetic voice. Key components are a means of producing speech signals at different levels of vocal effort, a processor capable of selecting the appropriate level of vocal effort to produce a speech signal, and a carefully calibrated audio system capable of accurately matching the RMS power of the signals reaching the listener's left and right eardrums to the power that would occur for a sound source 1 m directly in front of the listener in an anechoic environment.

20 Claims, 3 Drawing Sheets

SPEECH-BASED AUDITORY DISTANCE DISPLAY

RIGHTS OF THE GOVERNMENT

The invention described herein may be manufactured and used by or for the Government of the United States for all governmental purposes without the payment of any royalty.

BACKGROUND OF THE INVENTION

Historically, virtual audio displays have focused primarily on controlling the apparent direction of sound sources. This has been achieved by processing the sound with direction-dependent digital filters, called Head Related Transfer Functions (HRTFs), that reproduce the acoustic transformations that occur when a sound propagates from a distant source to the listener's left and right ears. The resulting processed sounds are presented to the listener over stereo headphones, and appear to originate from the direction relative to the listener's head corresponding to the location of the sound source during the HRTF measurement.

Only a few virtual audio display systems have attempted to control the apparent distances of sounds, all with limited success. In part, this is directly related to the lack of salient auditory distance cues in the free field. The binaural and spectral cues that listeners use to determine the directions of sound sources, which are captured by the HRTF and exploited by directional virtual audio displays, provide essentially no information about the distances of sound sources. Only when the sound source is within 1 m of the head are there any significant distance-dependent changes in the anechoic HRTF. Consequently, virtual audio displays are forced to rely on much less robust monaural cues to manipulate the apparent distances of sounds. Two types of monaural distance cues have been used in previous virtual audio displays. The first of these cues is based on intensity. In the free field, the overall level of the sound reaching the listener decreases 6 dB with each doubling in source distance. Listeners rely on this loudness cue to determine relative changes in the distances of sounds, so it is possible to reduce the apparent distance of a sound in an audio display simply by increasing its amplitude. A number of earlier audio displays have used intensity cues to manipulate apparent distance.

While the intensity cue is useful for simulating changes in the relative distance of a sound, it provides little or no information about the absolute distance of the sound unless the listener has substantial a priori knowledge about the intensity of source. Thus, listeners generally will not be able to identify the distance of a sound source in meters or feet from the intensity cue alone. The intensity cue also requires a wide dynamic range to be effective. Since the source intensity must increase 6 dB each time the distance of the source is decreased by half, 6 dB of dynamic range is required for each factor of 2 change in simulated distance. This is not a problem in quiet listening environments, but in noisy environments like aircraft cockpits, where virtual audio displays are often most valuable, the range of distance manipulation possible with intensity cues is very limited. Far away sounds will be attenuated below the noise floor and become inaudible, and nearby sounds will be uncomfortably loud or will overdrive the headphone system. It has been recognized in the prior art that all distances should be scaled to the range from 10 cm to 10 m from the listener's head in order to make the loudness cue effective in aerospace applications. Even this compressed range of simulated distances would require a dynamic range of 27 dB, which would be difficult to achieve in the cockpit of a tactical jet aircraft.

The second type of cue that has been used in known audio distance displays is based on reverberation. In a reverberant environment, the direct signal from the source decreases in amplitude 6 dB for each doubling in distance, while the reverberant sound in the room is roughly independent of distance. Consequently, it is possible to determine the distance of a sound source from the ratio of direct energy to reverberant energy in the audio signal. When the source is nearby, the direct-to-reverberant ratio is large, and when the source is distant, this direct-to-reverberant ratio is small. This cue has previously been used to manipulate apparent distance in a virtual audio display. The importance of reverberation in human distance perception has been demonstrated in psychoacoustic experiments and it is known to provide some information about the absolute distance of a sound. However, it also has serious drawbacks. The dynamic range requirements of the reverberation cue are just as demanding as those with the intensity cue, since the direct sound level changes 6 dB with each doubling in distance and must be audible in order to determine the direct-to-reverberant energy ratio. Reverberation cues are also computationally intensive, since each simulated room reflection requires as much processing power as a single source in an anechoic environment. They require the listener to have some a priori knowledge about the reverberation properties of the listening environment, and may produce inaccurate distance perception when the simulated listening environment does not match the visual surroundings of the listener. And reverberation can decrease the intelligibility of speech and the listener's ability to localize the directions of all types of sounds.

One type of auditory distance cue that has not been exploited in any previous virtual audio displays is based on the changes that occur in the characteristics of speech when the talker increases the output level of his or her voice. These changes make it possible for a listener to estimate the output level of the talker solely from the acoustic properties of the speech signal. Whispered speech, for example, is easily identified from the lack of voicing and implies a relatively low production level. Shouted speech, which is characterized by a higher fundamental frequency and greater high-frequency energy content than conversational speech, implies a relatively high production level. Since the intensity of the speech signal decreases 6 dB for each doubling in the distance of the talker, a listener should be able to estimate the distance of a live talker in the free field by comparing the apparent production level of speech to the level of the signal heard at the ears.

The salience of these voice-based distance cues has been confirmed in perceptual studies, which have shown that listeners can make reasonably accurate judgments about the distances of live talkers. Other studies have shown that whispered speech is perceived to be much closer than conversational speech and conversational speech is perceived to be much closer than shouted speech when all three types of speech are presented at the same listening level.

The present invention relies on the novel concept that virtual synthesis techniques can be used to systematically manipulate the perceived distance of speech signals over a wide range of distances. The present invention illustrates that the apparent distances of synthesized speech signals can be reliably controlled by varying the vocal effort and loudness of the speech signal presented to the listener and that these speech-based distance cues are remarkably robust across different talkers, listeners, and utterances. The invention described herein is a virtual audio display that uses manipulations in the vocal effort and presentation level to control the apparent distances of synthesized speech signals.

SUMMARY OF THE INVENTION

A device and method for controlling the perceived distances of sound sources by manipulating the vocal effort and presentation level of a synthetic voice. The key components are a means of producing speech signals at different levels of vocal effort, a processor capable of selecting the appropriate level of vocal effort to produce a speech signal with the desired apparent distance at the desired presentation level, and a carefully calibrated audio system capable of accurately matching the RMS power of the signals reaching the listener's left and right eardrums to the power that would occur for a sound source 1 m directly in front of the listener in an anechoic environment.

It is therefore an object of the invention to provide a virtual audio display for perceived distance of speech.

It is another object of the invention to provide a method and device for controlling perceived distances of sound sources by manipulating the vocal effort and presentation level of a synthetic voice.

It is another object of the invention to provide a means of producing speech signals at different levels of vocal effort.

These and other objects of the invention are achieved by the description, claims and accompanying drawings and by a speech-based virtual audio distance display device comprising:

- a first external input comprising a control computer interface that determines a desired distance of a simulated sound source from an external system driving said display;
- a second external input comprising operator selection of a desired listening level;
- a non-volatile memory device storing a plurality of prerecorded speech signals;
- a variable mode vocal effort processor determining an appropriate pre-recorded speech signal for a specific application from said non-volatile memory device storing a plurality of pre-recorded speech signals based on said first and second external inputs;
- a synthesized speech utterance absolute output level controlling calibration factor scaling said appropriate prerecorded speech signal output to a listener in accordance with said second external input; and
- a head related transfer function virtual audio display processing a signal output from said synthesized speech utterance output level controlling calibration factor and presenting said signal to a listener via headphones.

DETAILED DESCRIPTION

Figure 1:
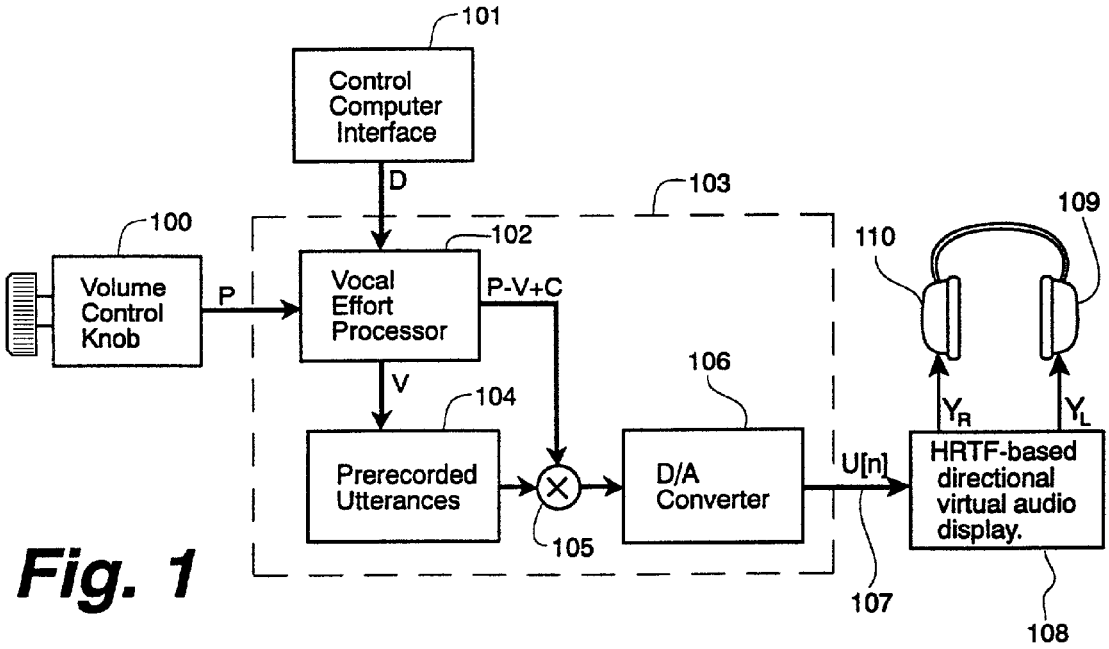
FIG. 1 is a schematic diagram of the speech based auditory distance display system of the invention.

A schematic diagram of the invention is shown in FIG. 1. The operation of the virtual audio distance display is controlled by two external inputs: a control computer interface shown at 101 that determines the desired distance of the simulated sound source D, in meters, from the external systems driving the display; and a volume control knob shown at 100 that allows the listener to determine the desired listening level P in dB SPL. These inputs are used to select the proper voice signal from a non-volatile digital table of prerecorded speech utterances at different levels of vocal effort V at 104 through the use of a vocal effort processor, shown at 102, based on a psychoacoustic evaluation of the effects of vocal effort and presentation level on the perceived distance of speech. The selected utterance is then multiplied by P−V+C (where C is a calibration factor that, like P and V, is expressed in dB) in order to adjust the level of the utterance output to the listener via headphones to the desired listening level P. This scaled signal is converted to an analog signal by a D/A converter represented at 106. Finally, the signal is sent to an external virtual audio display system, shown at 108, that processes the signal with HRTFs in order to add directional cues to the speech signal, and presents the processed speech signal to the listener via headphones, shown at 109.

The key components of the system are the table of prerecorded speech signals, the calibration factor C used to control the absolute output level of the synthesized speech utterances in dB SPL, and the vocal effort processor for selecting the vocal effort of the speech. Each of these components is described in more detail below.

Figure 2:
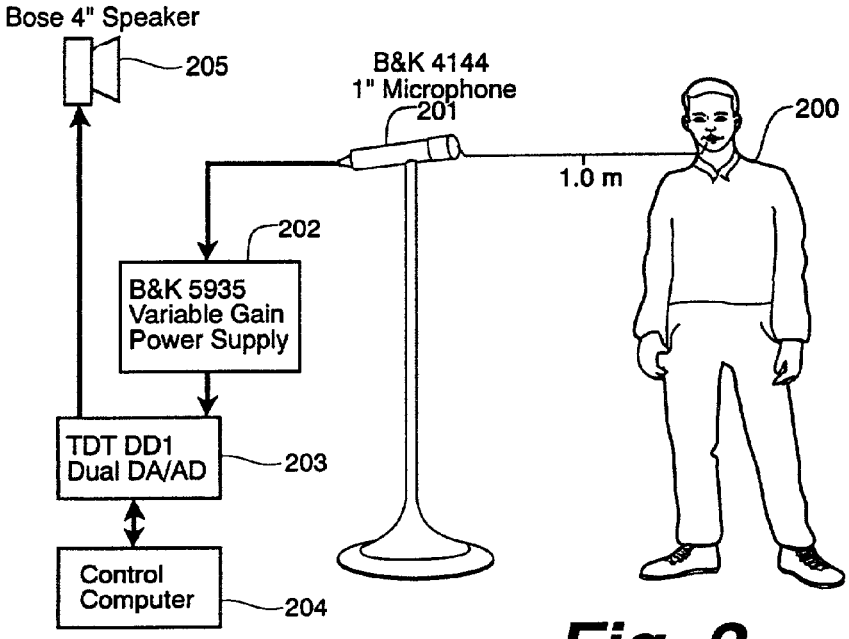
FIG. 2 shows a collection of speech utterances.

One of the key components of the invention is a non-volatile memory device that stores a table of digitally recorded speech samples of a single utterance spoken across a wide range of different vocal effort levels. The careful recording of these utterances is critical to the operation of the invention and is illustrated in FIG. 2. The speech samples are collected in an anechoic chamber. In one corner of the chamber, a B&K 4144 1" pressure microphone shown at 201 is mounted on an adjustable stand. The output of the microphone is connected to a B&K 5935 variable-gain microphone power supply, shown at 202, located in an adjacent control room, and passed through a 10 Hz-20 kHz band-pass filter (Krohn-Hite 3100) before terminating at the input of a Tucker-Davis DD1 16 bit, 50 kHz A/D converter, shown at 203. In addition, a loudspeaker shown at 205 connected to the output of the DD1 D/A converter at 203 is located near the center of the anechoic chamber and used to prompt the talkers to repeat a particular utterance. The entire recording process is controlled by a Pentium II-based PC in the control room, represented at 204, which prompts the listener for each utterance and records the resulting utterances to disk for later integration into the auditory distance display. Before measuring the speech samples from each subject, a 1 kHz, 94 dB calibrator is placed on the microphone and used to record a 5 s calibration tone. This calibration tone is used to determine the sound pressure levels of the subsequent measurements. Prior to each set of measurements, the microphone is adjusted to the height of the talker's mouth and the talker uses a 1 m rod to position his or her chin exactly 1 m from the microphone. Then the talker is instructed to begin speaking in their quietest whisper and to increase the loudness of the speech slightly on each repetition until they are unable to whisper any louder. The experimenter then leaves the room, and instructs the control computer to begin measuring the speech samples. The procedure for each measurement is as follows:

1. The loudspeaker prompts the talker with a recording of the desired utterance followed by a beep.

2. At the sound of the beep, the talker repeats the utterance at the appropriate level of vocal effort, and the D/A converter records the talker's speech.

3. A graph of the speech sample is plotted on the screen of the control computer, and examined by the experimenter for any signs of clipping. If clipping occurs, the experimenter adjusts the gain of the microphone power supply down by 10 dB, and the talker repeats steps 1–2 at the same loudness level. If no clipping occurs, the speech samples are saved (along with the gain of the variable power supply), and the talker is asked to increase the loudness level slightly.

4. Steps 1–3 are repeated until the subject is unable to whisper any louder. Then the subject is instructed to repeat the utterances in their quietest conversational (voiced) tone and to slightly increase the loudness of their speech on each repetition, and steps 1–3 are repeated until the subject is unable talk any louder without shouting. Finally, the subjects are asked to repeat the utterances in their quietest shouted voice and to increase their output slightly with each repetition, and steps 1–3 are repeated until the subject is unable to shout any louder.

Once all the speech data are collected, each digital sample is visually inspected and truncated to the beginning and end of the speech signal. Then the recordings are scaled to eliminate differences in the gain of the microphone power supply from the speech samples. Finally, the vocal effort V of each utterance is calculated by comparing its overall RMS power to the RMS power of the 94 dB calibration tone. Careful measurement of V is critical to selection of the proper speech utterance in order to produce speech sounds at the desired apparent distance. Note that the number of levels of vocal effort recorded in this technique will vary according to the dynamic range of the talker and the rate at which the talker increases his or her voice between data samples. In order to ensure adequate distance resolution in the display, the entire procedure should be repeated until speech samples are obtained with at least 3 dB resolution in V over the entire range of voiced speech, from approximately 48 dB to approximately 96 dB. In addition, one completely unvoiced (whispered) speech sample should be recorded for each talker and each utterance.

Note that this entire recording process should be repeated for each desired voice utterance that will be used in the distance display. Once they are collected and digitized, the samples should be compiled into a digital array and stored in a non-volatile digital memory, such as a hard-drive or flash RAM. This digital array should be sorted by the vocal effort level of each utterance V and indexed by a list of all available levels of V in the table for each available talker and utterance. In addition, one whispered sample of each talker speaking each utterance should be scaled to have an RMS power of 36 dB SPL and stored in the digital array with V=36 dB, and the 5-second long 94 dB, 1 kHz calibration tone should also be stored in the array with V=0 dB.

The digital array should be able to retrieve the recorded utterances according to the vocal effort level V requested by the vocal effort processor (shown at 102 in FIG. 1). When the vocal effort processor sends the value V to the digital array, the array searches all the voiced utterances in the table with the desired talker and utterance for the one closest to the desired vocal effort V. Although the selected utterance will not match the desired vocal effort exactly, if the speech samples were recorded with 3 dB resolution it should always be possible to produce a voiced speech sample within 1.5 dB of the desired level over the range from 48 dB to 96 dB SPL. When the vocal effort processor selects V=36 dB, the array selects the whispered recording of the utterance. When the processor selects V=0 dB, the array selects the 94 dB calibration tone. Once the proper utterance is selected, it is scaled by the value P−V+C, sent to the D/A converter in the display (at 106 in FIG. 1), processed by the directional audio display (108 in FIG. 1), and presented to the listener over headphones.

Calibration Factor (C)

Figure 3A:
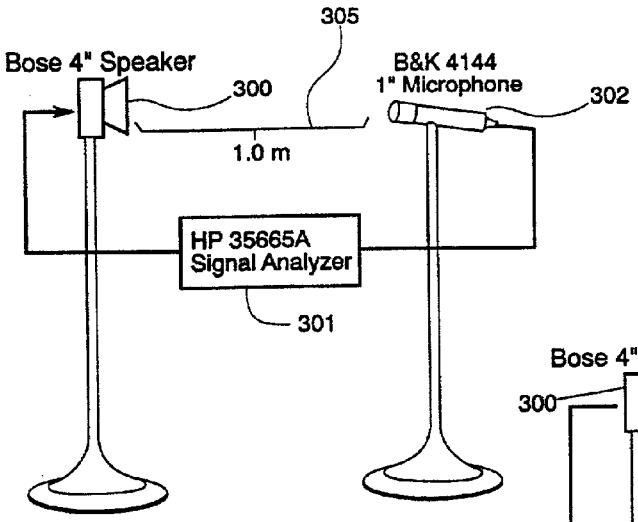
FIG. 3*a* illustrates generation of a free field signal.

A significant aspect of the present invention is the crucial role that absolute level plays in the apparent distance of the sounds. In most known auditory displays, no absolute reference is used for the overall level of the simulated sounds. Relative changes in sound level with the distance and direction of the source are captured by the HRTFs, but little or no effort is made to match absolute sound pressure level of the simulated sound source to the level that would occur with a comparable physical source in the free field. In the speech-based audio display of the invention, however, accurate control of the presentation level of the synthesized speech is known to have an important influence on the apparent distances of the utterances. In order to accurately control the perceived distances of the simulated speech signals, it is necessary to precisely control the level of the speech signals at the listener's ears. Thus, it is necessary to precisely measure the calibration factor C, which represents the relationship between the amplitude of the digital signals stored in the audio display and the amplitude of the audio signal produced at the listener's ears when those signals are converted to analog form and output to the listener through headphones. The calibration procedure used to establish C is shown in FIGS. 3*a*–3*c*.

Figure 3B:
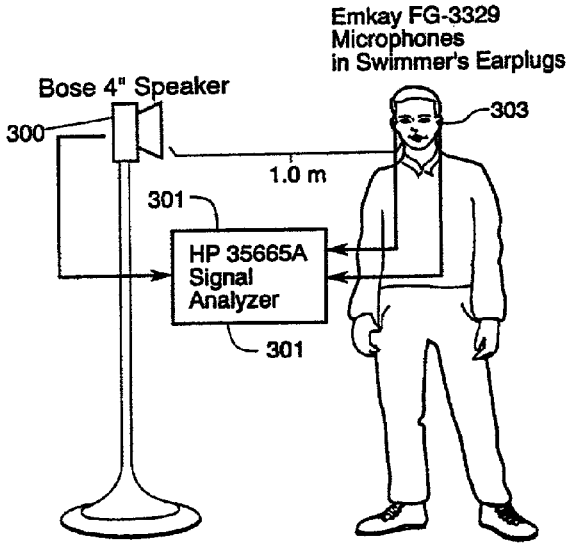
FIG. 3*b* illustrates measurements of a signal at a listener's ears.
Figure 3C:
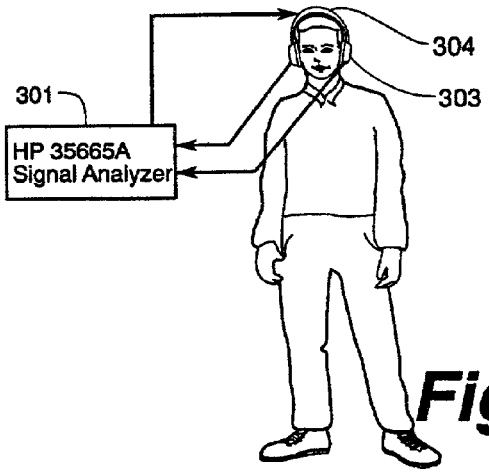
FIG. 3*c* illustrates headphone calibration.

In order to compare the sound pressure levels at the listener's ears in free field and headphone listening conditions, Emkay FG-3329 miniature microphones are attached to rubber swimmer's earplugs and inserted into the listener's ears, shown at 303 in FIG. 3*b*. Then a loudspeaker, shown at 300 in FIGS. 3*a* and 3*b*, in an anechoic chamber is used to generate an 84 dB SPL, 1 kHz tone at the location 1 m in front of the loudspeaker, the 1 m distance represented at 305. The level of the tone is verified with a calibrated microphone, shown at 302 in FIG. 3*a*, connected to an HP35665A dynamic signal analyzer, shown at 301 in FIGS. 3*a*–3*c*. Once the desired sound field is in place, the listener is positioned with the loudspeaker 1.0 m directly in front of the center of the head and the output voltage of the right in-ear microphone, 303, at 1 kHz is measured with the signal analyzer 301. The speaker 300 is then disconnected, the Sennheiser HD540 headphones used by the audio display, shown at 304 in FIG. 3*c*, are placed over the in-ear microphones, and the voltage of a 1 kHz sinusoidal signal driving the headphones is adjusted until the output voltage at the right in-ear microphone matches the level that occurs in the 84 dB sound field. The voltage level at the right-ear microphone is measured in dBV with the signal analyzer and is assigned the variable name $V_{HP}$.

This 84 dB headphone voltage is used to calculate the calibration-scaling factor C. First, the 94 dB, 1 kHz calibration tone stored in the table of prerecorded utterances, (104 in FIG. 1), is output through the D/A converter, (106 in FIG. 1), and the HRTF-based directional virtual audio display (108 in FIG. 1) while setting the scaling factor P−V+C to unity gain (0 dB). The directional virtual audio display is set to produce sounds directly in front of the listener, and the resulting output to the right headphone $Y_R$ is measured with a spectrum analyzer and assigned the voltage level $V_0$ in dBV. Since the 94 dB calibration tone was measured at a level 10 dB higher than the headphone calibration voltage, the correct calibration factor C is equivalent to $V_{HP}-V_0+10$ (in dB). When the calibration factor C is used in the display architecture shown in FIG. 1 and P=V, each prerecorded utterance will be presented to the listener's ears at exactly the same level that would occur for a live free-field talker speaking at the same level of vocal effort 1 m directly in front of the center of the listener's head. When P is unequal to V, the speech signal is presented to the ears at the same level as a far-field speech signal that would have RMS power P dB SPL at the location of the center of the listener's head. Thus, the calibration factor C allows precise control of the overall level of the headphone-presented speech.

Vocal Effort Processor

The last major component of the speech-based audio distance display of the invention is the vocal effort processor, which selects the correct level of vocal effort V that will produce a prerecorded utterance at the desired apparent distance D in meters when the sound is presented at the listening level P selected by the listener. The vocal effort processor can operate in two modes. In the first mode, the processor selects the utterance that will exactly match the signal the listener would hear if a live talker were located at distance D in a free-field environment. In this mode, the selected vocal effort is simply $$V=P+20\log_{10}D. \quad \text{(Eq. 1)}$$

Note that the selected utterance will be scaled by P-V before presentation to the listener, so, in most cases, the actual signal heard by the listener is at the presentation level. However, because the prerecorded utterances are available only over a limited range, this will not always be the case. If V is less than 48 dB, then the processor sets V to 48 dB and the final signal will be presented V-48 dB quieter than P. If V is greater than 96 dB, then the processor sets V to 96 dB and the final signal will be presented V-96 dB louder than P.

Figure 4:
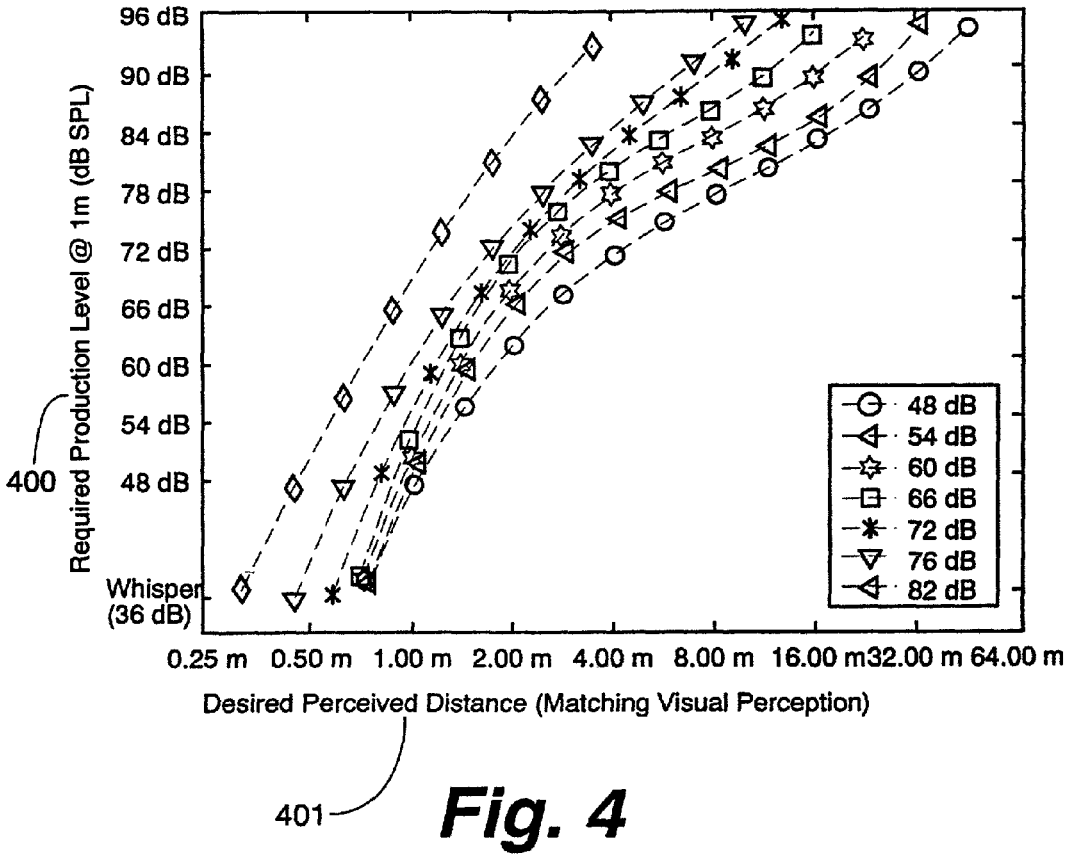
FIG. 4 illustrates the relationship between perceived distance, production level and presentation level.

In the second mode, the processor uses psychoacoustic data to select the value of V that will produce a sound perceived at the same distance as a visual object located D meters from the listener. This value of V is obtained from a lookup table of the data shown in FIG. 4 and Table 1, which have been derived from extensive psychoacoustic measurements of the effects of vocal effort and presentation level on the production level of speech. In FIG. 4 the x-axis at 401 represents desired perceived distance and the y-axis at 400 represents required production level at 1 m. The curves are expressed as cubic polynomials of the form $$V=\alpha\log_2(D)^3+\beta\log_2(D)^2+\delta\log_2(D)+\epsilon \quad \text{(Eq. 2)}$$

where V is the required vocal effort level in decibels, D is the desired apparent distance in meters, and $\alpha,\beta,\delta$, and $\epsilon$ are coefficients derived from a polynomial fit to the psychoacoustic data.

The curves are used to determine the value of V that will produce the desired apparent distance D at the desired production level P, by selecting the correct coefficients for the production level from Table 1 and plugging them into the above equation. For example, if the desired distance D is 8 m and the desired presentation level P is 66 dB, $$V=0.54\log_2(8)^3-4.71\log_2(8)^2+20.15\log_2(8)+53.54 \quad \text{(Eq. 3)}$$

which evaluates to 86 dB. For presentation levels between the curves, linear interpolation is used. For example, if the desired presentation level was 69 dB, then the point midway between the 66 dB curve and the 72 dB curve at D=8.0 m would be used for V ((0.5*(86 dB+89 dB))=88 dB).

Note that in some cases the curves will select vocal effort levels less than 48 dB. When the curves select a vocal effort that is closer to 36 dB than 48 dB, the whispered speech utterance is automatically selected and produces the desired apparent distance D in the utterance. If the desired distance is too close to be achieved even with the whispered signal at the desired presentation level (i.e. V<36 dB), then V is set at 36 dB to select the whispered signal is selected and P is increased until the desired apparent distance is obtained. If the desired distance is too far away to be achieved at the desired presentation level (the point is to the right of the curve even at V=96 dB), then V is set to 96 dB and P is reduced to level required to produce the desired distance. For example, if D=8 m and P=82 dB, than the vocal effort processor will not be able to achieve the desired distance at P=82 dB. The processor sets V to 96 dB and reduces P to 77 dB, which is the highest presentation level where an apparent distance of 8.0 m can be achieved with a 96 dB vocal effort. The apparent distance of the sound can be reliably manipulated by a factor of approximately 150 (from 0.3 m to 45 m) when the vocal effort processor is operated in this mode.

TABLE 1

Table of coefficients for determining production level V (in dB) from presentation level P (in dB) and desired apparent distance D (in m).

| P | α | β | δ | ϵ |
|---|---|---|---|---|
| 48 dB | 0.37 | −3.79 | 18.04 | 46.80 |
| 54 dB | 0.67 | −6.01 | 22.41 | 48.16 |
| 60 dB | 0.60 | −5.52 | 22.10 | 50.13 |
| 66 dB | 0.85 | −6.80 | 23.88 | 52.32 |
| 72 dB | 0.52 | −4.53 | 19.81 | 55.15 |
| 76 dB | 0.34 | −2.96 | 16.54 | 59.83 |
| 84 dB | −0.10 | −1.54 | 16.37 | 68.05 |

The proposed invention represents a completely novel way of presenting robust, reliable auditory distance information to a listener in a virtual audio display. The system has substantial advantages over existing auditory display systems. The speech-based distance cues used by the system are completely intuitive, and can be used to estimate the absolute distance of the cues without any prior knowledge about the talker, the utterance, or the listening environment. Speech-based distance cues are based on a listener's natural perception of speech and his or her experiences interacting with hundreds of different talkers at different conversational distances. Psychoacoustic experiments have shown that listeners require little or no training to use the speech-based cues, and that the differences in the cues across different talkers and utterances are essentially negligible. Different listeners also interpret the cues similarly.

These properties provide this speech-based audio display with substantial advantages over prior auditory distance displays based on reverberation or loudness cues. In those displays, an untrained listener is only able to judge relative changes in the distances of sounds. In order to make absolute judgments, the listener either must be trained with the intensity of the source or the properties of the simulated room environment or must make assumptions about these properties. In many applications, spatial audio cues are applied to warning tones that are heard only rarely by the listener and only under stressful conditions, and under these conditions it is likely that the intuitive speech-based distance cues provided by this audio display will be interpreted more accurately than loudness or reverberation-based cues even if the listener has received some training with the display.

The speech-based distance cues provided by the display of the invention require a much smaller dynamic range than previous audio distance displays. As noted earlier, reverberation- and intensity-based audio displays require 6 dB in dynamic range for each factor of two increase in the span of simulated distances. In contrast, the speech-based audio display can manipulate speech signals over a wide range of apparent distances at a fixed presentation level. Since it is necessary only to be able to hear the speech signal, the dynamic range requirements of the speech-based display are no greater than those for a speech intercom system. In noisy environments such as aircraft cockpits, this gives the speech-based audio display a tremendous advantage over the prior art.

The speech-based distance cues are completely compatible with currently available directional virtual audio displays and they do not interfere with directional localization ability, as can happen in reverberation-based distance displays.

There are many possible alternative implementations of the system of the invention as described in the arrangements herein. One portion of the system that is completely optional is the directional virtual audio display that is used to control the perceived direction of the speech sounds output by the display. The system can operate with or without this directional system. The derivation of the input signals P and D, representing the desired presentation level and apparent distance of the output signal, could also be determined by any convenient means. For example, the control computer might be used to manipulate the presentation level of the speech instead of a knob directly controlled by the user.

In addition, a larger range of voiced speech or a larger range of presentation levels could be used than those described in the present arrangements. As in this present system, the relationship between apparent distance, vocal effort, and presentation level would be determined through psychoacoustic testing and integrated into the table shown in FIG. 4.

Finally, a different method could be used to produce the speech samples. In this system, the samples are prerecorded from a live talker at each vocal effort level. However, it would also be possible to use electronic processing to manipulate the properties of a speech signal to match those that occur when an actual talker raises or lowers the level of his or her voice. For example, Linear Predictive Coding (LPC) synthesis could be used to simulate changes in the vocal effort of speech by manipulating the fundamental frequency, formant frequencies, spectral tilt, and other acoustic properties of speech to match the properties of actual speech produced at a given level of vocal effort. These manipulations could be done on a vocabulary of prerecorded utterances, or LPC Analysis processing, and synthesis techniques could be used to modify the apparent vocal effort levels (and distances) of communications speech signals in real time. This type of implementation would be substantially more flexible than the prerecorded vocabulary system described here.

While the apparatus and method herein described constitute a preferred embodiment of the invention, it is to be understood that the invention is not limited to this precise form of apparatus or method and that changes may be made therein without departing from the scope of the invention, which is defined in the appended claims.

What is claimed is:

1. A speech-based virtual audio distance display device comprising:

a first external input comprising a control computer interface that determines a desired distance of a simulated sound source from an external system driving said display;

a second external input comprising operator selection of a desired listening level;

a non-volatile memory device storing a plurality of prerecorded speech signals;

a variable mode vocal effort processor determining an appropriate pre-recorded speech signal for a specific application from said non-volatile memory device storing a plurality of pre-recorded speech signals based on said first and second external inputs;

a synthesized speech utterance absolute output level controlling calibration factor scaling said appropriate prerecorded speech signal output to a listener in accordance with said second external input; and a head related transfer function virtual audio display processing a signal output from said synthesized speech utterance output level controlling calibration factor and presenting said signal to a listener via headphones.

2. The speech-based virtual audio distance display device of claim 1, wherein said pre-recorded speech signals are comprised of a single utterance across a wide range of vocal effort levels.

3. The speech-based virtual audio distance display device of claim 1, wherein said head related transfer function virtual audio display further comprises head related transfer functions adding directional cues to a signal output from said synthesized speech utterance output level controlling calibration factor.

4. The speech-based virtual audio distance display device of claim 1 wherein said synthesized speech utterance output controlling calibration factor further comprises:

amplitude of digital signals stored in audio display relative to amplitude of the audio signal produced at the listener's ears when those signals are converted to analog form and output to the listener through headphones.

5. The speech-based virtual audio distance display device of claim 1 wherein said variable mode vocal effort processor further comprises a first and second mode, said first mode comprising:

an utterance selection that exactly matches a signal the listener would hear if a live talker were located at a distance D in a free field environment.

6. The speech-based virtual audio distance display device of claim 5 wherein said second mode of said variable mode vocal effort processor comprises:

psychoacoustic data used to select a calibration factor that produces a sound perceived at the same distance as a visual object located D meters from the listener.

7. The speech-based virtual audio distance display device of claim 1 wherein said second external input comprises operator selection using a manual control knob.

8. The speech-based virtual audio distance display device of claim 1 further comprising a D/A converter for converting a signal output from said synthesized speech utterance output level controlling calibration factor from digital to analog.

9. The speech-based virtual audio distance display device of claim 1 wherein said variable mode vocal effort processor comprises a first mode wherein said processor selects the utterance that will exactly match the signal the listener would hear if a live talker were located a preselected distance D in a free field.

10. The speech-based virtual audio distance display device of claim 1 wherein said variable mode vocal effort processor comprises a second mode wherein said processor uses psychoacoustic data to select the level of vocal effort that will produce a sound perceived at the same distance as a visual object located a distance D from the listener.

11. A method for providing a speech-based auditory distance display comprising the steps of:

first externally inputting a desired distance of a simulated sound source from an external system driving said display;

second externally inputting a desired listening level;

storing a plurality of pre-recorded speech signals in a non-volatile memory device;

determining an appropriate pre-recorded speech signal for a specific application from said non-volatile memory device storing a plurality of pre-recorded speech signals based on said first and second external inputs using a variable mode vocal effort processor;

scaling said appropriate pre-recorded speech signal output to a listener in accordance with said second external input using a synthesized speech utterance output level controlling calibration factor; and processing a signal output from said synthesized speech utterance absolute output level controlling calibration factor with head related transfer functions adding directional cues to said signal and presenting said signal to a listener via headphones.

12. The method of claim 11 for providing a speech-based auditory distance display wherein said storing step further comprises the step of storing a plurality of pre-recorded speech signals comprising a single utterance across a wide range of vocal effort levels in a non-volatile memory device.

13. The method of claim 11 for providing a speech-based auditory distance display wherein said storing step further includes storing a plurality of pre-recorded speech signals comprised of a single utterance in a non-volatile memory device.

14. The method of claim 11 for providing a speech-based auditory distance display wherein said scaling step further comprises:

comparing amplitude of digital signals stored in audio display relative to amplitude of the audio signal produced at the listeners ears, and converting an output from said comparing step to analog form and outputting to a listener through headphones.

15. The method of claim 11 for providing a speech-based auditory distance display wherein said variable mode vocal effort processor further comprises a first and second mode, said first mode comprising an utterance selection that exactly matches a signal the listener would hear if a live talker were located at a distance D in a free field environment.

16. The method of claim 11 for providing a speech-based auditory distance display wherein said second mode of said variable mode vocal effort processor comprises psychoacoustic data used to select a calibration factor that produces a sound perceived at the same distance as a visual object located D meters from the listener.

17. The method of claim 11 for providing a speech-based auditory distance display wherein said pre-recorded speech signals from said storing step are obtained by employing the steps comprising:

prompting a talker to repeat a particular utterance by providing a loudspeaker with a recording of a desired utterance at a center of an anechoic chamber;

providing a pressure microphone in said anechoic chamber wherein a talker repeats said utterance at an appropriate level of vocal effort; and controlling said steps for obtaining pre-recorded speech signals using a personal computer located in a control room, said personal computer prompting a listener for each utterance and recording said utterance to disk for later integration into said auditory distance display and repeating said steps of prompting and providing for each vocal effort level ranging from a whisper to a shouted voice.

18. The method of claim 17 for providing a speech-based auditory distance display further including the steps of:

inspecting each of said pre-recorded speech signals;

truncating each signal from beginning to end;

eliminating differences in microphone power gain from said speech signals; and calculating a vocal effort of each utterance by comparing its overall RMS power to a RMS or prerecorded calibration tone.

19. The method of claim 11 for providing a speech-based auditory distance display wherein said step of externally inputting further comprises the step of manually operating a listening level selectable control knob.

20. The method of claim 11 for providing a speech-based auditory distance display further including a step of converting a signal output from said scaling step from digital to analog using a D/A converter.

* * * * *